US005793018A

United States Patent [19]

Jett

[11] Patent Number: 5,793,018

[45] Date of Patent: Aug. 11, 1998

[54] HANDHELD HAIR BRAID FUSING TONGS WITH BELL-SHAPED FUSING MEMBERS

[76] Inventor: Ricki Rene Jett, 22005 Haan Ave., Riverside, Calif. 92518

[21] Appl. No.: 751,654

[22] Filed: Nov. 18, 1996

[51] Int. Cl.[6] ..... A45D 1/14; A45D 1/04

[52] U.S. Cl. ..... 219/225; 132/224; 132/219; 227/81; 426/426.5; 294/3; D8/52

[58] Field of Search ..... 219/225, 227–229, 219/222, 221; 132/224, 232, 234; 81/418, 424.5, 426.5; 294/99.2, 3, 8.5, 11, 106; D8/52, 53; 606/207, 205

[56] References Cited

U.S. PATENT DOCUMENTS

| | | | |
|---|---|---|---|
| D. 313,671 | 1/1991 | Ichikawa | D28/35 |
| D. 342,002 | 12/1993 | Sage | D8/52 |
| D. 350,465 | 9/1994 | Walsky | D8/52 |
| 1,045,640 | 11/1912 | Thompson | 294/99.2 |
| 1,422,826 | 7/1922 | Brown | 219/225 |
| 1,455,696 | 5/1923 | Wright | 219/225 |
| 2,065,807 | 12/1936 | Johnson | 219/222 |
| 2,474,147 | 6/1949 | Hill et al. | 219/225 |
| 2,776,667 | 1/1957 | Fitzgerald | 132/224 |
| 3,955,064 | 5/1976 | Demetrio et al. | 219/225 |
| 5,354,967 | 10/1994 | Barzilai et al. | 219/225 |
| 5,357,988 | 10/1994 | Nakamura | 132/232 |
| 5,394,862 | 3/1995 | Firatli et al. | 126/409 |
| 5,400,810 | 3/1995 | Taylor | 132/232 |

FOREIGN PATENT DOCUMENTS

| | | | |
|---|---|---|---|
| 669479 | 11/1929 | France | 219/225 |
| 827872 | 5/1938 | France | 219/222 |
| 373627 | 5/1932 | United Kingdom | 219/225 |

*Primary Examiner*—John A. Jeffery

[57] ABSTRACT

A braid fuse assembly including a pliers mechanism with a bell-shaped fuse unit coupled thereto. The fuse unit has two halves coupled to the pliers mechanism wherein upon the pliers mechanism having an open orientation, the halves of the fuse mechanism are situated distant with respect to each other and upon the pliers mechanism having a closed orientation, the halves abut each other. In use, the fuse mechanism is adapted to be heated via an electric heater embedded in the bell-shaped fuse unit.

1 Claim, 2 Drawing Sheets

HANDHELD HAIR BRAID FUSING TONGS WITH BELL-SHAPED FUSING MEMBERS

BACKGROUND OF THE INVENTION

1. Field of the Invention

The present invention relates to a braid fuse assembly and more particularly pertains to fusing an end of a braid.

2. Description of the Prior Art

The use of hair irons is known in the prior art. More specifically, hair irons heretofore devised and utilized for the purpose of molding hair are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,357,988 to Nakamura; U.S. Pat. No. 3,955,064 to Demetrio et al.; U.S. Patent Des. 313,671 to Ichikawa; U.S. Pat. No. 5,400,810 to Taylor; U.S. Pat. No. 5,394,862 to Firatli et al.; and U.S. Pat. No. 5,354,967 to Barzilai et al.

In this respect, the braid fuse assembly according to the present invention substantially departs from the conventional concepts and designs of the prior art, and in so doing provides an apparatus primarily developed for the purpose of allowing an end of a braid to be fused.

Therefore, it can be appreciated that there exists a continuing need for a new and improved braid fuse assembly which can be used for allowing an end of a braid to be fused. In this regard, the present invention substantially fulfills this need.

SUMMARY OF THE INVENTION

In view of the foregoing disadvantages inherent in the known types of hair irons now present in the prior art, the present invention provides an improved braid fuse assembly. As such, the general purpose of the present invention, which will be described subsequently in greater detail, is to provide a new and improved braid fuse assembly which has all the advantages of the prior art and none of the disadvantages.

To attain this, the present invention essentially comprises a pair of tongs. Each tong includes a linear inboard extent, an outboard linear extent, and an intermediate extent coupled between the inboard extent and the outboard extent. By this structure, the linear inboard extent and the outboard extent are parallel and offset a predetermined distance. The intermediate extents of each tong are pivotally coupled at a central extent thereof. Further provided are pair of elastomeric heat resistant handles. Each handle has a tubular configuration with a length equivalent to that of the outboard extents of the pliers for being situated about the same. Also included is a bell-shaped fuse mechanism having two halves. As best shown in FIG. 3, each half has an inboard portion with a curved cross-section, an outboard portion with a flanged cross-section, and an intermediated portion with a linear cross-section. The inboard portion of each half is coupled to an outboard end of the an associated outboard extent of the pliers. In use, upon the pliers having an open orientation, the halves of the fuse mechanism are situated distant with respect to each other. Further, upon the pliers having a closed orientation, the halves abut each other such that the fuse mechanism is in the shape of a bell with an axis about which the bell is formed residing in a parallel relationship with respect to the inboard extents and outboard extents of the pliers. As shown in FIGS. 3 and 4, a heating assembly is included with an insulated heating coil serpentinely situated within each of the halves of the fuse mechanism. A double stranded first connecting wire is situated within each of the outboard extents and intermediate extents of the pliers. See FIG. 4. Such first connecting wires are further connected at a first end thereof to the heating coil of the associated half of the fuse mechanism. An exterior wire is coupled at a first end thereof to a second end of one of the first connecting wires and further spliced with a second end of the other first connecting wire within a common tong. A second connecting wire is positioned within the inboard extent of one of the tongs and further extended distant the pliers. The second connecting wire is thereby adapted for coupling with a conventional power receptacle thus providing power to the connecting wires and further heating the fuse mechanism.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved braid fuse assembly which has all the advantages of the prior art hair irons and none of the disadvantages.

It is another object of the present invention to provide a new and improved braid fuse assembly which may be easily and efficiently manufactured and marketed.

It is a further object of the present invention to provide a new and improved braid fuse assembly which is of a durable and reliable construction.

An even further object of the present invention is to provide a new and improved braid fuse assembly which is susceptible of a low cost of manufacture with regard to both materials and labor, and which accordingly is then susceptible of low prices of sale to the consuming public, thereby making such braid fuse assembly economically available to the buying public.

Still yet another object of the present invention is to provide a new and improved braid fuse assembly which provides in the apparatuses and methods of the prior art some of the advantages thereof, while simultaneously overcoming some of the disadvantages normally associated therewith.

Still another object of the present invention is to allow an end of a braid to be fused.

Lastly, it is an object of the present invention to provide a new and improved braid fuse assembly including a pliers mechanism with a bell-shaped fuse unit coupled thereto. The fuse unit has two halves coupled to the pliers mechanism wherein upon the pliers mechanism having an open orientation, the halves of the fuse mechanism are situated distant with respect to each other and upon the pliers mechanism having a closed orientation, the halves abut each other. In use, the fuse mechanism is adapted to be heated.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
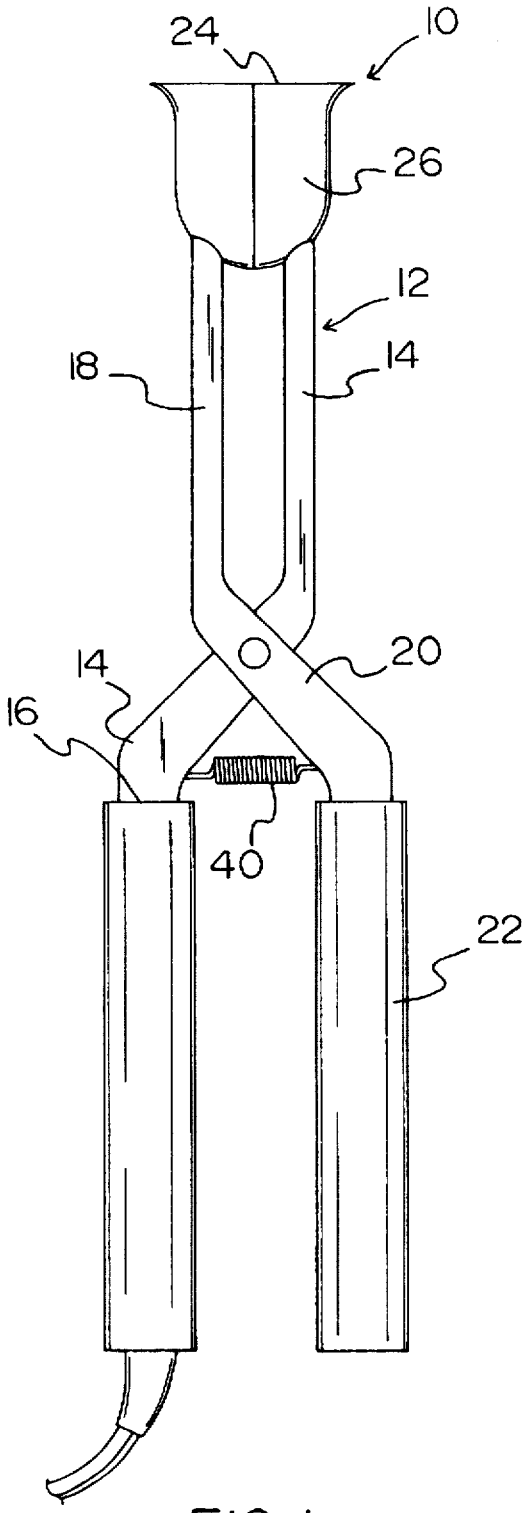
FIG. 1 is a perspective illustration of the preferred embodiment of the braid fuse assembly constructed in accordance with the principles of the present invention.

With reference now to the drawings, and in particular to FIG. 1 thereof, a new and improved braid fuse assembly embodying the principles and concepts of the present invention and generally designated by the reference numeral 10 will be described.

The present invention, the new and improved braid fuse assembly, is comprised of a plurality of components. Such components in their broadest context include a pliers, handles, fuse mechanism, and heating assembly. Such components are individually configured and correlated with respect to each other so as to attain the desired objective.

More specifically, it will be noted that the system 10 of the present invention includes a pliers assembly 12 including a pair of tongs 14. Each tong includes a linear inboard extent 16, an outboard linear extent 18, and an intermediate extent 20 coupled between the inboard extent and the outboard extent. Ideally, the inboard and outboard extents are of a similar length such that the device has a total length of approximately 10 inches. By this structure, the linear inboard extent and the outboard extent are parallel and offset a predetermined distance. The intermediate extents of each tong are pivotally coupled at a central extent thereof with a pivoting rivet.

Further provided are pair of elastomeric heat resistant handles 22. Each handle has a tubular configuration with a length equivalent to that of the outboard extents of the pliers for being situated about the same.

Figure 2:
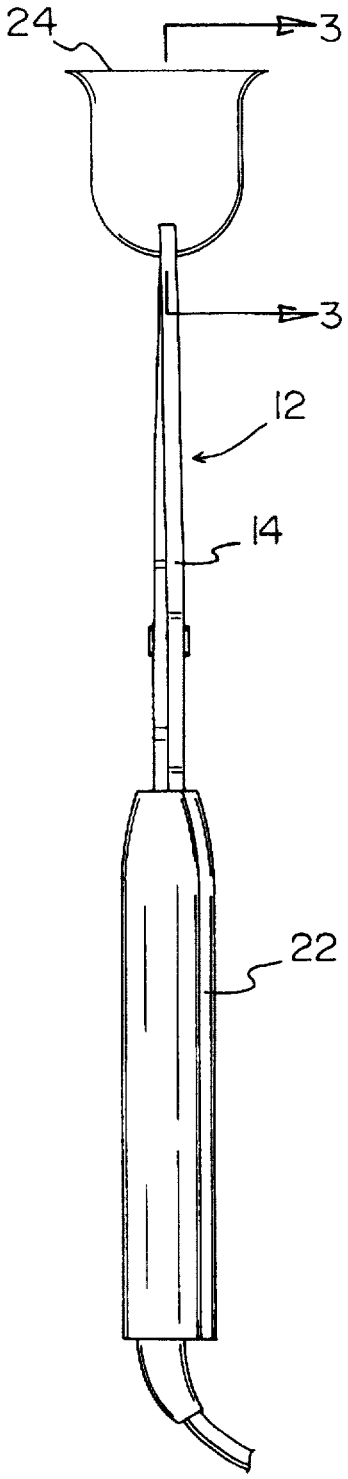
FIG. 2 is side elevational view of the present invention.
Figure 3:
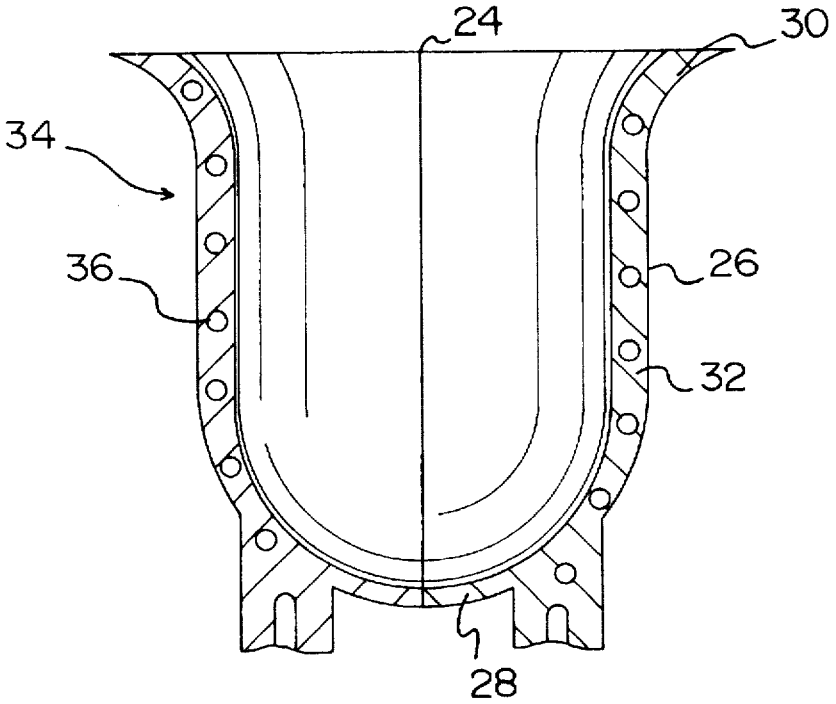
FIG. 3 is a cross-sectional view of the present invention taken along line 3—3 shown in FIG. 2.

Also included is a bell-shaped fuse mechanism 24 having two halves 26. As best shown in FIG. 3, each half has an inboard portion 28 with a curved cross-section, an outboard portion 30 with a flanged cross-section, and an intermediated portion 32 with a linear cross-section. The inboard portion of each half is coupled to an outboard end of the an associated outboard extent of the pliers. As an option, a hollow interior of the bell may be coated with TEFLON™. In use, upon the pliers having an open orientation with the inboard extents distant, the halves of the fuse mechanism are situated distant with respect to each other. Further, upon the inboard extents of the pliers having a closed orientation with the inboard extents abutted, the halves abut each other such that the fuse mechanism is in the shape of a bell with an axis about which the bell is formed residing in a parallel relationship with respect to the inboard extents and outboard extents of the pliers. Preferably, the bell that is formed has a diameter of approximately ¼ inch. Also, to insure that the edges of the halves 26 abut properly, it is preferred that the outboard extents of the pliers are bent slightly as shown in FIG. 2.

In an unillustrated alternate embodiment, the periphery of the inboard portion of each half of the fuse mechanism may be sharpened. As such, upon an end of a braid being inserted within the fuse mechanism and the pliers being closed, any unwanted excess hair is cut.

Figure 4:
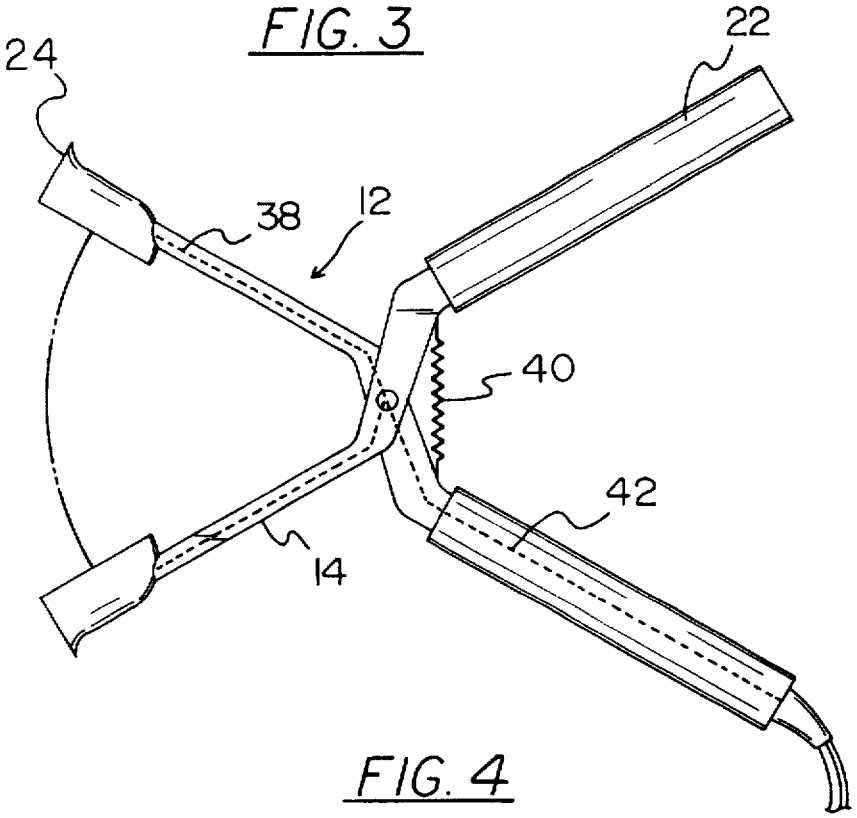
FIG. 4 is a side view of the pliers of the present invention in an open orientation.

As shown in FIGS. 3 and 4, a heating assembly 34 is included with an insulated heating coil 36 serpentinely situated within each of the halves of the fuse mechanism. A double stranded first connecting wire 38 is situated within each of the outboard extents and intermediate extents of the pliers. See FIG. 4. Such first connecting wires are further connected at a first end thereof to the heating coil of the associated half of the fuse mechanism. An exterior wire 40 is coupled at a first end thereof to a second end of one of the first connecting wires and further spliced with a second end of the other first connecting wire within a common tong. A second connecting wire 42 is positioned within the inboard extent of one of the tongs and further extended distant the pliers. The second connecting wire is coupled at a first end thereof to the point at which the first connecting wires are spliced and further coupled at a second end thereof to a conventional power receptacle thus providing power to the connecting wires and further heating the fuse mechanism. As shown in FIG. 1, a grommet may be utilized at the point the second connecting wire exits the pliers to prevent the severing thereof. A transformer may also be employed to ensure proper voltage is supplied to the heating coil. In addition, it should be noted that batteries may be employed in lieu of the household power receptacle.

In use, power is applied to the heating coils and time is given to allow them to heat. Next, the pliers are transferred to the closed orientation thereof with an end of a braid residing within the fuse mechanism. As such, the end of the braid is fused and precluded from unravelling.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A braid fuse assembly comprising, in combination:

a pliers assembly including a pair of tongs each including a linear inboard extent, an outboard linear extent, and an intermediate extent coupled between the inboard extent and the outboard extent wherein the linear inboard extent and the outboard extent are parallel and offset a predetermined distance, whereby the intermediate extents of each tong are pivotally coupled at a central extent thereof via a rivet, wherein the outboard linear extents are bent inwardly;

a pair of elastomeric heat resistant handles each having a tubular configuration with a length equivalent to that of the outboard extents of the pliers for being situated about the outboard extents of the pliers;

a bell-shaped fuse mechanism having two halves each with an inboard portion with a curved cross-section, an outboard portion with a flanged cross-section, and an intermediated portion with a linear cross-section, the inboard portion of each half coupled to an outboard end of the an associated outboard extent of the pliers, wherein upon the pliers having an open orientation, the halves of the fuse mechanism are situated distant with respect to each other and upon the pliers having a closed orientation, the halves abut each other such that the fuse mechanism is in the shape of a bell with an axis about which the bell is formed residing in a parallel relationship with respect to the inboard extents and outboard extents of the pliers, wherein an interior surface of each of the halves is lined with a slippery material; and a heating assembly including an insulated heating coil serpentinely situated within each of the halves of the fuse mechanism, a double stranded first connecting wire situated within each of the outboard extents and intermediate extents of the pliers and further connected at a first end thereof to the heating coil of the associated half of the fuse mechanism, an exterior wire coupled at a first end thereof to a second end of one of the first connecting wires and further spliced with a second end of the other first connecting wire within a common tong, and a second connecting wire positioned within the inboard extent of one of the tongs and further extending distant the pliers for coupling with a conventional power receptacle for providing power to the connecting wires and further heating the fuse mechanism.

* * * * *